US008899067B2

(12) United States Patent
Otake et al.

(10) Patent No.: US 8,899,067 B2
(45) Date of Patent: Dec. 2, 2014

(54) REFRIGERATING APPARATUS

(75) Inventors: Masahisa Otake, Ora-gun (JP); Setsu Hasegawa, Ora-gun (JP); Ken Kawakubo, Ora-gun (JP); Hidetaka Sasaki, Ora-gun (JP)

(73) Assignee: SANYO Electric Co., Ltd., Moriguchi-shi (JP)

( * ) Notice: Subject to any disclaimer, the term of this patent is extended or adjusted under 35 U.S.C. 154(b) by 1260 days.

(21) Appl. No.: 12/652,431

(22) Filed: Jan. 5, 2010

(65) Prior Publication Data

US 2010/0186604 A1 Jul. 29, 2010

(30) Foreign Application Priority Data

Jan. 28, 2009 (JP) ..... 2009-016446

(51) Int. Cl.

| | |
|---|---|
| ***A23C 3/04*** | (2006.01) |
| ***F25D 17/02*** | (2006.01) |
| ***F25B 7/00*** | (2006.01) |
| ***F25B 39/04*** | (2006.01) |
| ***F25B 41/00*** | (2006.01) |
| ***F25C 5/10*** | (2006.01) |
| ***F25C 1/04*** | (2006.01) |
| ***F25B 29/00*** | (2006.01) |
| ***F25D 31/00*** | (2006.01) |

(52) U.S. Cl.

CPC ..... *F25B 29/003* (2013.01); *F25D 31/002* (2013.01); *F25B 2309/061* (2013.01); *F25B 2600/2513* (2013.01)

USPC ..... 62/434; 62/175; 62/208; 62/183; 62/352; 62/356; 99/455

(58) Field of Classification Search

USPC ..... 62/352, 59, 356, 434; 99/455

See application file for complete search history.

(56) References Cited

U.S. PATENT DOCUMENTS 4,130,996 A * 12/1978 Sult ..... 62/113
4,216,659 A * 8/1980 French ..... 62/186

(Continued)

FOREIGN PATENT DOCUMENTS

CN 1231410 A 10/1999
CN 101029785 A 9/2007

(Continued)

OTHER PUBLICATIONS

Chinese Office Action dated Apr. 19, 2011, issued in corresponding Chinese Patent Application No. 201010103982.9.

*Primary Examiner* — Allen Flanigan
*Assistant Examiner* — Filip Zec
(74) *Attorney, Agent, or Firm* — Westerman, Hattori, Daniels & Adrian, LLP

(57) ABSTRACT

A refrigerating apparatus including a control unit which starts the operation of the refrigerant compressor in response to an operation signal and which regulates the pressure reducing device so that the temperature of a refrigerant in the water heat exchanger becomes +80 ° C. or more and the temperature of the refrigerant in the evaporator becomes 0 ° C. or less. The control unit detects a state where a cold storage amount in the cold storage unit reaches a predetermined amount or more and another state where the control unit judges whether the hot water storage tank is full of the hot water, after the elapse of a predetermined time from the start of the operation of the refrigerant compressor, and it stops the operation of the refrigerant compressor when one of the states is satisfied.

5 Claims, 4 Drawing Sheets

(56) References Cited

U.S. PATENT DOCUMENTS

| | | | | |
|---|---|---|---|---|
| 4,907,417 | A * | 3/1990 | Forsythe | 62/199 |
| 6,543,245 | B1 * | 4/2003 | Waldschmidt et al. | 62/239 |
| 7,856,835 | B2 * | 12/2010 | Ida | 62/150 |
| 2003/0200757 | A1 * | 10/2003 | Hawkins et al. | 62/59 |
| 2007/0056302 | A1 | 3/2007 | Otake et al. | |

FOREIGN PATENT DOCUMENTS

| | | | |
|---|---|---|---|
| JP | 55-99553 | A | 7/1980 |
| JP | 09-236316 | A | 9/1997 |
| JP | 11-006665 | A | 1/1999 |
| JP | 2007-078266 | A | 3/2007 |
| JP | 2008-309384 | A | 12/2008 |

* cited by examiner

REFRIGERATING APPARATUS

BACKGROUND OF THE INVENTION

The present invention relates to a refrigerating apparatus including a refrigerant circuit in which a refrigerant compressor, a water heat exchanger, a pressure reducing device and an evaporator are annularly connected by piping, and the refrigerating apparatus is configured to heat water supplied from a hot water storage tank and circulated through a water circuit by the water heat exchanger and to cool ambient water by the evaporator, thereby enabling cold storage.

Heretofore, as a method for cooling a cooling target such as food or beverage, a refrigerating apparatus using an evaporating compression type refrigerating cycle has broadly been utilized. In this type of refrigerating apparatus, the cooling target is cooled by a heat absorbing function by the evaporation of a refrigerant in an evaporator, and heat is radiated to the atmosphere by the heat radiation of the refrigerant in a radiator.

In recent years, in this type of refrigerating apparatus, attempts have been made to reuse the heat which has heretofore been released to the atmosphere and has not been utilized in the radiator (a heat exchanger), thereby effectively utilizing energy, and as one example of the attempts, an apparatus utilizing the heat radiated from the radiator (a water heat exchanger) for the supply of hot water has been developed.

Specifically, a high-temperature high-pressure refrigerant compressed by a compressor of the refrigerating cycle is caused to flow into the water heat exchanger, and in the water heat exchanger, heat exchange is performed between the refrigerant and water supplied from a hot water storage tank. By such heat exchange, the heat of the refrigerant is absorbed by the water discharged from the lower part of the hot water storage tank, whereby the heat is radiated.

On the other hand, the low temperature water discharged from the lower part of the hot water storage tank is heated by the heat exchange between the water and the refrigerant in this water heat exchanger, that is, the heat radiating function of the refrigerant, thereby obtaining the high temperature water (the hot water), and the water returns into the hot water storage tank through the upper part of the hot water storage tank. In this way, the low temperature water is discharged from the lower part of the hot water storage tank, and heated by the heat exchange between the water and the refrigerant flowing through the heat exchanger, and the high temperature water (the hot water) is returned into the hot water storage tank through the upper part thereof. When this operation is repeated, the high temperature hot water is stored from the upper part to the lower part of the hot water storage tank.

On the other hand, the refrigerant having the temperature lowered in the heat exchanger is contracted by an expansion valve, expands, has a low pressure, and then flows into the evaporator where the refrigerant expands, that is, evaporates. By the evaporating function of this refrigerant, the cooling target (e.g., the water) around the evaporator is cooled. Afterward, the refrigerant is discharged from the evaporator and sucked into the compressor again. By such a heat absorbing function of the refrigerant in the evaporator, the cooling target is cooled (e.g., when the cooling target is the water and the refrigerant is evaporated at 0° C. or less, ices are produced), and simultaneously by the heat radiating function of the refrigerant in the water heat exchanger, the high temperature hot water is produced (e.g., see JP-A-2007-78266 (Patent Document 1)).

In the above refrigerating apparatus, the operation of the refrigerating cycle is performed until the temperature of the cooling target cooled by the evaporator becomes a predetermined low temperature and the total amount of the water in the hot water storage tank is boiled (i.e., the hot water storage tank is full of the hot water). That is, even when the hot water storage tank is full of the hot water but when the cooling target is not sufficiently cooled, such a cooling operation is continued. In this case, however, the water supplied from the hot water storage tank and flowing through the heat exchanger is the sufficiently heated high temperature hot water, whereby the heat taken from the cooling target by the refrigerant in the evaporator cannot be released from the heat exchanger, which causes a problem that the refrigerating cycle is brought into an overloaded state.

On the other hand, even in a state in which the cooling target is sufficiently cooled, when the hot water storage tank is not full of the hot water, the cooling operation is continued. In this case, however, while flowing through the evaporator, the refrigerant cannot absorb the heat from the cooling target, and hence the water flowing through the heat exchanger cannot sufficiently be heated. Furthermore, the refrigerant cannot absorb the heat to evaporate in the evaporator, which might generate a liquid back flow, that is, the returning of a liquid refrigerant into the compressor.

The present invention has been developed to solve such problems of the conventional technology, and an object thereof is to provide a refrigerating apparatus which eliminates a disadvantage that a refrigerant circuit is overloaded and which can safely be operated.

SUMMARY OF THE INVENTION

According to a first aspect of the present invention, there is provided a refrigerating apparatus comprising: a refrigerant circuit in which a refrigerant compressor, a water heat exchanger, a pressure reducing device and an evaporator are annularly connected by refrigerant pipes; a hot water storage tank having a lower part through which tap water is supplied and an upper part through which hot water stored therein is discharged; a water circuit in which the tap water in the lower part of the hot water storage tank is heated by the water heat exchanger and then returned to the upper part of the hot water storage tank; a cold storage unit into which the evaporator is immersed; and a control unit which starts the operation of the refrigerant compressor in response to an operation signal and which regulates the pressure reducing device so that the temperature of a refrigerant in the water heat exchanger becomes +80° C. or more and so that the temperature of the refrigerant in the evaporator becomes 0° C. or less, wherein the control unit detects a state of a case where a cold storage amount in the cold storage unit reaches a predetermined amount or more and a state of a case where the control unit judges that the hot water storage tank is full of the hot water, after the elapse of a predetermined time from the start of the operation of the refrigerant compressor, and stops the operation of the refrigerant compressor when one of the states is satisfied.

A second aspect of the present invention is directed to the refrigerating apparatus according to the first aspect of the present invention, wherein milk to be supplied to a milk tank is cooled by cold water supplied from the cold storage unit, and the inside of the milk tank is heated or washed by using the hot water in the hot water storage tank.

A third aspect of the present invention is directed to the refrigerating apparatus according to the first aspect or the second aspect of the present invention, wherein the cold storage unit is configured to produce ices therein.

A fourth aspect of the present invention is directed to the refrigerating apparatus according to any one of the first to third aspects of the present invention, which has a constitution to discharge the hot water from the hot water storage tank, and wherein the control unit has a usual operation mode and a preferential cooling mode, and in the usual operation mode, the control unit detects the state of the case where a cold storage amount in the cold storage unit reaches the predetermined amount or more and the state of the case where the control unit judges that the hot water storage tank is full of the hot water, and stops the operation of the refrigerant compressor when one of the states is satisfied, and in the preferential cooling mode, after having judged that the hot water storage tank is full of the hot water, the control unit discharges the hot water from the hot water storage tank to continue the operation of the refrigerant compressor.

The refrigerating apparatus of the first aspect of the present invention comprises the refrigerant circuit in which the refrigerant compressor, the water heat exchanger, the pressure reducing device and the evaporator are annularly connected by the refrigerant pipes; the hot water storage tank having the lower part through which the tap water is supplied and the upper part through which the hot water stored therein is discharged; the water circuit in which the tap water in the lower part of the hot water storage tank is heated by the water heat exchanger and then returned to the upper part of the hot water storage tank; the cold storage unit into which the evaporator is immersed; and the control unit which starts the operation of the refrigerant compressor in response to the operation signal and which regulates the pressure reducing device so that the temperature of the refrigerant in the water heat exchanger becomes +80° C. or more and so that the temperature of the refrigerant in the evaporator becomes 0° C. or less, wherein this control unit detects the state of the case where the cold storage amount in the cold storage unit reaches the predetermined amount or more and the state of the case where the control unit judges that the hot water storage tank is full of the hot water, after the elapse of the predetermined time from the start of the operation of the refrigerant compressor, and stops the operation of the refrigerant compressor when one of the states is satisfied. Therefore, the heat radiation of the refrigerant in the water heat exchanger and the evaporation of the refrigerant in the evaporator can securely be performed.

In consequence, it is possible to eliminate a disadvantage that the heat absorption amount of the refrigerant in the evaporator runs short, and a disadvantage that the heat radiation amount of the refrigerant in the water heat exchanger runs short and that the refrigerant circuit is overloaded, whereby a safe operation can be performed.

According to the second aspect of the present invention, in the above invention, the milk to be supplied to the milk tank is cooled by the cold water supplied from the cold storage unit, and the inside of the milk tank is heated or washed by using the hot water in the hot water storage tank. Therefore, the inside of the milk tank can be heated and washed, or washed by the hot water in the hot water storage tank.

According to the third aspect of the present invention, in the first aspect or the second aspect of the present invention, the cold storage unit is configured to produce the ices therein, whereby by the heat absorbing function of the refrigerant in the evaporator immersed into the cold storage unit, the ices can be produced in the cold storage unit to perform the cold storage of the refrigerant circuit.

According to the fourth aspect of the present invention, in any one of the first to third aspects of the present invention, the apparatus has the constitution to discharge the hot water from the hot water storage tank, and the control unit has the usual operation mode and the preferential cooling mode, and in the usual operation mode, the control unit detects the state of the case where the cold storage amount in the cold storage unit reaches the predetermined amount or more or the state of the case where the control unit judges that the hot water storage tank is full of the hot water, and stops the operation of the refrigerant compressor when the state is satisfied, and in the preferential cooling mode, after having judged that the hot water storage tank is full of the hot water, the control unit discharges the hot water from the hot water storage tank to continue the operation of the refrigerant compressor. Therefore, in the preferential cooling mode, when the hot water storage tank is full of the hot water, the hot water can be discarded from the hot water storage tank, the low temperature water can be supplied to the hot water storage tank, and the low temperature water can flow through the water heat exchanger.

In consequence, while eliminating the disadvantage that the heat radiation amount of the refrigerant in the water heat exchanger runs short and that the refrigerant circuit is overloaded, the cold storage in the cold storage unit can safely and securely be performed.

DETAILED DESCRIPTION OF THE PREFERRED EMBODIMENT

Hereinafter, embodiments of a hot water supply apparatus of the present invention will be described in detail with reference to the drawings.

(Embodiment 1)

Figure 1:
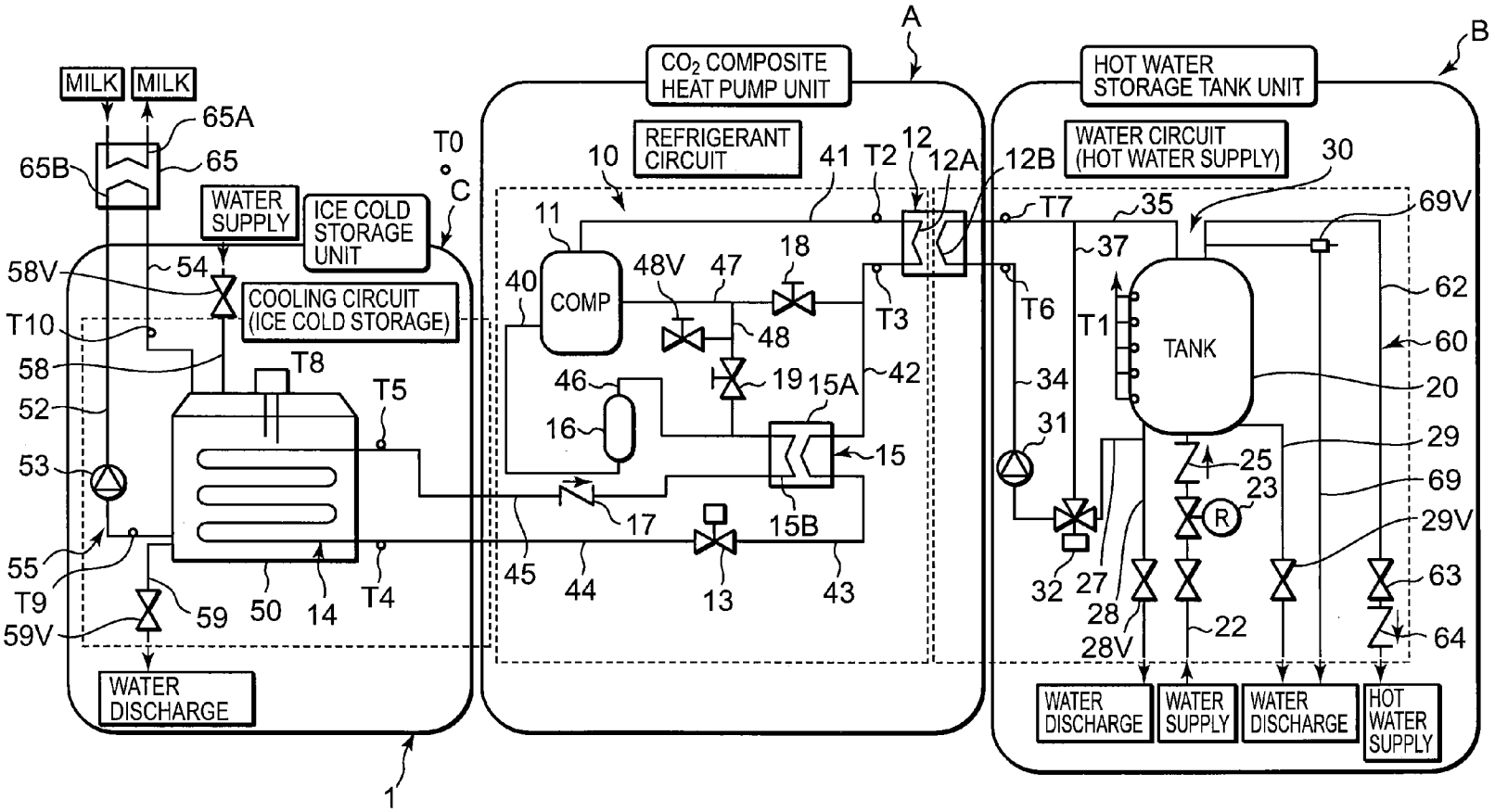
FIG. 1 is a circuit diagram of a refrigerating apparatus of one embodiment to which the present invention is applied.

FIG. 1 shows a circuit diagram of a refrigerating apparatus 1 of one embodiment to which the present invention is applied. The refrigerating apparatus 1 of the present embodiment is constituted of a heat pump unit (a $CO_2$ composite heat pump unit) A having a refrigerant circuit 10, a hot water storage tank unit B including a hot water storage tank 20, a water circuit 30 through which water is circulated between a water heat exchanger 12 of the refrigerant circuit 10 and the hot water storage tank 20, and an ice cold storage unit (a cold storage unit) C having an ice cold storage tank 50.

In the heat pump unit A, water (tap water supplied to the hot water tank) from the hot water storage tank 20 is heated to produce high-temperature water (hot water), and water in the ice cold storage tank 50 of the ice cold storage unit C is cooled to produce ices. In the heat pump unit A of the embodiment, a refrigerant compressor 11, a refrigerant passage (a radiator) 12A of the water heat exchanger 12, an expansion valve 13 as a pressure reducing device and an evaporator 14 are annularly connected by refrigerant pipes to constitute the refrigerant circuit 10. As an operation refrigerant, for example, carbon dioxide ($CO_2$) is used.

Specifically, in the refrigerant circuit 10 of the present embodiment, the refrigerant compressor 11, a refrigerant discharge pipe 41, the refrigerant passage 12A of the water heat exchanger 12, a refrigerant pipe 42, a high pressure side pipe 15A of an internal heat exchanger 15, a refrigerant pipe 43, the expansion valve 13, a refrigerant pipe 44, the evaporator 14, a refrigerant pipe 45, a low pressure side pipe 15B of the internal heat exchanger 15, a refrigerant pipe 46, an accumulator 16 and a refrigerant introduction pipe 40 are successively annularly connected to form a closed circuit. The refrigerant compressor 11 is an internal intermediate pressure type two-stage compression type compressor including a driving element in a sealed container (not shown), and a low stage side compression element and a high stage side compression element driven by the driving element. A refrigerant compressed by the low stage side compression element is discharged into the sealed container, and the refrigerant in the sealed container is sucked and compressed in the high stage side compression element.

Here, the water heat exchanger 12 includes the refrigerant passage 12A (corresponding to the radiator) on a refrigerant circuit 10 side and a water passage 12B on a water circuit 30 side, and the refrigerant passage 12A is connected to the water passage 12B so as to have a heat exchange relation therebetween (in a heat exchange manner) and so that the refrigerant discharged from the refrigerant compressor 11 and flowing through the refrigerant passage 12A faces the flow of the water discharged from the hot water storage tank 20 and flowing through the water passage 12B, that is, so as to form a counter flow.

Moreover, in the internal heat exchanger 15, heat exchange is performed between the high pressure side refrigerant discharged through the refrigerant passage 12A and the low pressure side refrigerant discharged from the evaporator 14, and the internal heat exchanger includes the high pressure side pipe 15A through which the high pressure side refrigerant from the refrigerant passage 12A flows and the low pressure side pipe 15B through which the low pressure side refrigerant from the evaporator 14 flows. The high pressure side pipe 15A and the low pressure side pipe 15B are also disposed so as to have the heat exchange relation therebetween (in the heat exchange manner) and so that the flows of the refrigerants flowing through the pipes 15A, 15B face each other (i.e., so as to form the counter flow).

In the refrigerant discharge pipe 41, a temperature sensor (a water heat exchanger inlet temperature sensor) T2 is attached which detects the temperature of the refrigerant entering the water heat exchanger 12 (the refrigerant passage 12A) (i.e., the temperature of the refrigerant discharged from the refrigerant compressor 11, corresponding to the temperature of the refrigerant in the water heat exchanger 12), and in the refrigerant pipe 42, a temperature sensor (a water heat exchanger outlet temperature sensor) T3 is attached which detects the temperature of the refrigerant discharged from the water heat exchanger 12 (the refrigerant passage 12A). Moreover, in the refrigerant pipe 44, a temperature sensor (an evaporator inlet temperature sensor) T4 is attached which detects the temperature of the refrigerant entering the evaporator 14 (corresponding to the temperature of the refrigerant in the evaporator 14), and in the refrigerant pipe 45, a temperature sensor (an evaporator outlet temperature sensor) T5 is attached which detects the temperature of the refrigerant discharged from the evaporator 14.

Moreover, the accumulator 16 is provided to protect the refrigerant compressor 11 from a damage due to the suction of a liquid refrigerant or the like. Furthermore, in the refrigerant pipe 45 which connects the evaporator 14 to the low pressure side pipe 15B of the internal heat exchanger 15, a check valve 17 for preventing the return (back flow) of the refrigerant from the high pressure side of the refrigerant circuit to the evaporator 14 is interposed. It is to be noted that a pipe 47 is a bypass pipe which connects the sealed container (not shown) of the compressor 11 to the refrigerant pipe 42 connected to the outlet of the refrigerant passage 12A of the water heat exchanger 12, and a pipe 48 is a bypass pipe which connects the pipe 47 to the refrigerant pipe 46 connected to the outlet of the low pressure side pipe 15B of the internal heat exchanger 15. The bypass pipes 47, 48 are provided with evacuating bypass valves 18, 19 opened during refrigerant charging, and a charge valve 48V for the refrigerant charging.

In this refrigerant circuit 10, carbon dioxide ($CO_2$) is sealed as the refrigerant. Therefore, the pressure of the refrigerant in the refrigerant passage 12A or the like on the high pressure side of the refrigerant circuit 10 exceeds a super critical pressure, and hence the refrigerant circuit 10 has a transcritical cycle. Moreover, as a lubricant for the refrigerant compressor 11, an oil having a satisfactory solubility in the carbon dioxide refrigerant is used. For example, a mineral oil, an alkyl benzene oil, an ether oil, an ester oil, polyalkylene glycol (PAG), polyol ether (POE) or the like is used.

On the other hand, the hot water storage tank unit B is constituted of the hot water storage tank 20 whose outer peripheral surface is covered with an insulating material and in which hot water is stored; the water circuit 30 through which the water is circulated between the hot water storage tank 20 and the water passage 12B of the water heat exchanger 12; and a hot water supply circuit 60 through which the hot water is supplied to a hot water supply load equipment. The hot water storage tank 20 has a vertically long cylindrical shape, and has a lower part through which the tap water is supplied and an upper part through which the high temperature water (the hot water) stored therein can be discharged.

That is, the lower part of the hot water storage tank 20 is connected to a water supply pipe 22. This water supply pipe 22 has one end connected to a supply source of the tap water and the other end opened in the bottom part of the hot water storage tank 20, and along the water supply pipe, there are interposed a water supply valve 22V for controlling the supply of the water to the hot water storage tank 20, a pressure reducing valve 23 for decreasing the supply pressure of the tap water to a predetermined pressure of, for example, 170 kPa (about 1.7 kgf/cm$^2$), and a check valve 25 for preventing the outflow (the back flow) of the water from the hot water storage tank 20. Moreover, the tap water can constantly be supplied from the water supply pipe 22 to the hot water storage tank 20. Therefore, the water supply pressure (i.e., the water supply pressure decreased to the predetermined pressure by the pressure reducing valve 23 in the present embodiment) is constantly applied to the hot water storage tank 20.

Moreover, the lower part of the hot water storage tank 20 is connected to a water takeout pipe 27 of the water circuit 30 for discharging the low temperature water (mainly the tap water supplied into the hot water storage tank 20 through the water supply pipe 22) from the lower part of the hot water storage tank 20. This water takeout pipe 27 has one end opened in the bottom part of the hot water storage tank 20, and through this opening, the water (the tap water) can be discharged from the lower part of the hot water storage tank 20. Moreover, the middle part of the water takeout pipe 27 is connected to one end of a discharge pipe 28 including a discharge valve 28V. This discharge valve 28V can be opened to discharge the low temperature water in the lower part of the hot water storage tank 20 to the outside from the lower part of the hot water storage tank 20 through the water takeout pipe 27 and the discharge pipe 28.

Furthermore, the other end of the water takeout pipe 27 is connected to one of inlets of a three-way valve 32. The water circuit 30 is a circulation circuit through which the water (mainly the tap water supplied into the hot water storage tank 20 through the water supply pipe 22) in the lower part of the hot water storage tank 20 is caused to flow through the water passage 12B of the water heat exchanger 12, heated by heat exchange performed between the water and the refrigerant flowing through the refrigerant passage 12A provided so as to perform the heat exchange between the passage and the water passage 12B, and then returned to the upper part of the hot water storage tank 20. In the water circuit 30 of the present embodiment, the water takeout pipe 27, the three-way valve 32, a water pipe 34, the water passage 12B of the water heat exchanger 12 and a water pipe 35 are successively annularly connected, and the water pipe 34 is provided with a circulation pump 31 for causing the water to flow through the water passage 12B of the water heat exchanger 12. Moreover, the other inlet of the three-way valve 32 is connected to a bypass pipe 37. One end of the bypass pipe 37 is connected to the middle part of the water pipe 35.

The three-way valve 32 is controlled so that during usual hot water storage operation, the low temperature water from the lower part of the hot water storage tank 20 flows through the water passage 12B of the water heat exchanger 12 and then flows through the upper part of the hot water storage tank 20, that is, so that the water takeout pipe 27 is connected to the water pipe 34. In consequence, the hot water heated to the high temperature by the refrigerant in the water heat exchanger 12 is returned to the hot water storage tank 20 through the upper part thereof, and can be received in the upper part of the hot water storage tank 20.

On the other hand, in a situation where the refrigerant flowing through the refrigerant passage 12A of the water heat exchanger 12 immediately after the start of the hot water storage operation or the like does not sufficiently reach the high temperature, in the water heat exchanger 12, the low temperature water from the lower part of the hot water storage tank 20 cannot be heated to the high temperature by the refrigerant flowing through the refrigerant passage 12A. If such low temperature water is returned into the hot water storage tank 20 through the upper part thereof, temperature stratification due to the density difference of the hot water in the hot water storage tank 20 (i.e., the highest temperature water having a small density is stored in the upper part of the hot water storage tank 20, and the low temperature water having a large density is stored toward the lower part thereof) is disturbed, and the temperature of the hot water in the upper part of the hot water storage tank 20 is lowered. To solve the problem, in a case where the temperature of the water discharged through the water passage 12B of the water heat exchanger 12 is low in this manner, the three-way valve 32 is switched so that the water does not flow through the upper part of the hot water storage tank 20. That is, the three-way valve 32 is controlled so as to connect the bypass pipe 37 to the water pipe 34. In consequence, the water discharged through the water passage 12B of the water heat exchanger 12 does not flow into the hot water storage tank 20 but flows through the closed circuit where the water returns from the water pipe 35 to the water passage 12B of the water heat exchanger 12 through the bypass pipe 37, the three-way valve 32 and the water pipe 34.

It is to be noted that as described above, the water passage 12B and the refrigerant passage 12A of the water heat exchanger 12 are provided so as to perform the heat exchange therebetween and so that the water flowing through the water passage 12B and the refrigerant flowing through the refrigerant passage 12A form the counter flow. Moreover, in the water pipe 34, a temperature sensor (a hot water sensor) T6 for detecting the temperature of the water entering the water heat exchanger 12 (the water passage 12B) is attached. Moreover, the water pipe 35 returns the water (the hot water) flowing through the water passage 12B of the water heat exchanger 12 into the hot water storage tank 20 from the upper part thereof, and the outlet of the water passage 12B of the water heat exchanger 12 is connected to the upper part of the hot water storage tank 20 by the water pipe 35. Furthermore, the water pipe 35 is provided with a temperature sensor (a hot water sensor) T7 for detecting the temperature (the hot water outflow temperature) of the high temperature water (the hot water) heated by the heat exchange between the water (the water passage 12B) and the refrigerant flowing through the refrigerant passage 12A in the water heat exchanger 12.

Moreover, under the hot water storage tank 20 and above the water takeout pipe 27, a discharge pipe 29 including a discharge valve 29V is connected. Through this discharge pipe 29, the hot water is discharged from the hot water storage tank 20 in a case where the hot water storage tank 20 is full of the hot water in a preferential cooling mode described later, and the discharge valve 29V can be opened to discharge the hot water to the outside from the lower part of the hot water storage tank 20 through the discharge pipe 29.

On the other hand, the upper part of the hot water storage tank 20 is connected to a hot water supply pipe 62 of the hot water supply circuit 60. The hot water supply pipe 62 is provided with a hot water supply valve 63, and the hot water supply valve 63 can be opened to discharge the high temperature hot water stored in the upper part of the hot water storage tank 20 to the hot water supply pipe 62. Moreover, the hot water supply pipe 62 is provided with a check valve 64 for preventing the return (the back flow) of the hot water to the hot water storage tank 20. Furthermore, the middle part of the hot water supply pipe 62 is connected to a discharge pipe 69 via a pressure relief valve 69V. These components are provided to prevent the abnormal rise of the pressure in the hot water supply pipe 62. Specifically, if the pressure in the hot water storage tank 20 rises to a predetermined value or more, the pressure relief valve 69V is opened to discharge the high temperature water in the hot water storage tank 20 to the outside of the hot water supply circuit 60 through the discharge pipe 69. In consequence, the abnormal rise of the pressure in the hot water supply pipe 62 can be prevented.

It is to be noted that in the hot water storage tank 20, a plurality of hot water temperature detection sensors (remaining hot water amount sensors) T1 are vertically provided with a predetermined gap being left therebetween. The hot water temperature detection sensors T1 are sensors for detecting the temperatures of portions of the hot water stored in the hot water storage tank 20. In this way, the plurality of hot water storage sensors T1 are disposed at varying heights from the upper part of the hot water storage tank 20 to detect the temperatures of the portions, whereby the amount of the high temperature hot water (the remaining hot water amount) in the hot water storage tank 20 can be detected while grasping a temperature distribution from the upper part to the lower part of the hot water storage tank 20.

On the other hand, the ice cold storage unit C is constituted of the ice cold storage tank 50 in which the water is received and a cold supply circuit 55 through which the water (cold water) in the ice cold storage tank 50 is circulated. In the water stored in the ice cold storage tank 50, the evaporator 14 of the refrigerant circuit 10 is immersed, and the water in the ice cold storage tank 50 is cooled by the evaporator 14 to produce ices, thereby enabling cold storage in the refrigerant circuit 10. In the cold supply circuit 55, the cold stored in the ice cold storage tank 50 can be supplied to a heat exchanger 65 described later to cool milk as a cooling target in the heat exchanger 65.

The cold supply circuit 55 is constituted of a forwarding pipe 52 which connects the lower part of the ice cold storage tank 50 to the inlet of a water passage 65B provided in the heat exchanger 65, a return pipe 54 which connects the outlet of the water passage 65B to the upper part of the ice cold storage tank 50, and a circulation pump 53 which is provided in the forwarding pipe 52 to discharge the cold water (the cold) stored in the ice cold storage tank 50 from the lower part of the ice cold storage tank 50 and to supply the discharged cold water through the water passage 65B of the heat exchanger 65. Moreover, in the forwarding pipe 52, a temperature sensor (a cold water temperature sensor T9) is attached which detects the temperature of the cold water discharged from the ice cold storage tank 50 (i.e., corresponding to the temperature of the cold water in the ice cold storage tank 50). It is to be noted that a temperature sensor T10 is a sensor (a cold water temperature sensor) attached to the return pipe 54 to detect the temperature of the water returning to the ice cold storage tank 50.

Furthermore, the upper part of the ice cold storage tank 50 is connected to a water supply pipe 58, and the water supply pipe 58 is provided with a water supply valve 58V for controlling the supply of the water (the tap water) into the ice cold storage tank 50. Moreover, the lower part of the ice cold storage tank 50 is connected to a discharge pipe 59 in which a discharge valve 59V is interposed, and the discharge pipe 59 can be opened to discharge the water in the ice cold storage tank 50 to the outside through the discharge pipe 59. Furthermore, in the ice cold storage tank 50, a sensor T8 is provided. This sensor T8 is a water level sensor which detects the rise of a water level in the ice cold storage tank 50 to detect the completion of the ice cold storage (the tank is full of the ices).

Specifically, the water level sensor T8 is constituted of two sensors disposed at different heights in the ice cold storage tank 50. One sensor provided at a lower position is submerged in the water when the amount of the water supplied through the water supply pipe 58 reaches a predetermined amount, whereby the discharge valve 28V is closed to stop the supply of the water through the discharge pipe 28. Moreover, the other sensor is provided at a position which is higher than the one sensor and at which the sensor is submerged in the water when a predetermined amount of ices are produced around the evaporator 14 immersed into the ice cold storage tank 50. In a case where the two sensors are submerged in the water in this manner, a control unit Z described later judges that the ice cold storage is completed (the ice cold storage tank is full of the ices). It is to be noted that the sensor T8 is not limited to such a water level sensor, and may be an ice thickness sensor which detects the completion of the ice cold storage (the tank is full of the ices) by a capacitance across two electrodes, that is, which judges that the ice cold storage is completed in a case where any water is not stored but the ices are produced across the two electrodes.

Figure 2:
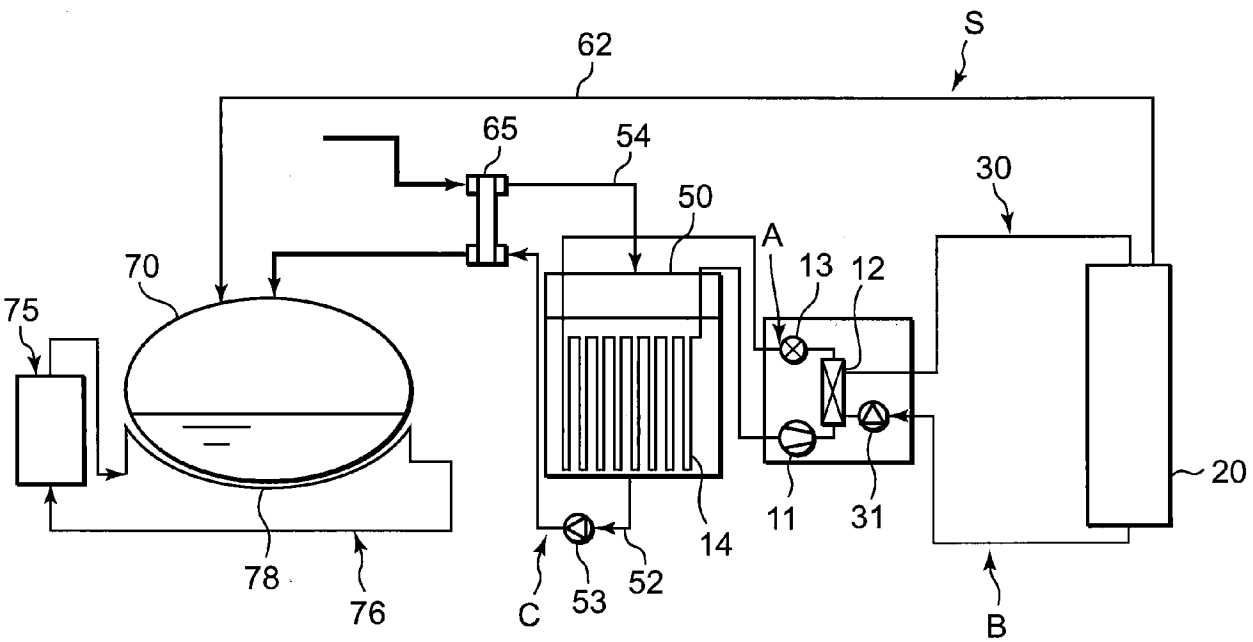
FIG. 2 is a schematic constitution diagram of a milk cooling system including the refrigerating apparatus of FIG. 1.

Next, FIG. 2 is a schematic constitution diagram of a milk cooling system S including the refrigerating apparatus 1 of FIG. 1. This milk cooling system S cools the milk supplied to a milk tank 70 by use of the cold storage in the ice cold storage unit C of the refrigerating apparatus 1.

In this case, the heat exchanger 65 is disposed along a path through which the milk supplied from a milking machine to the milk tank 70 passes. The heat exchanger 65 is constituted of a cooling passage 65A through which the milk (the cooling target) from the milking machine flows, and the water passage 65B through which the cold water from the ice cold storage tank 50 of the ice cold storage unit C flows, and the milk discharged from the milking machine and flowing through the cooling passage 65A of the heat exchanger 65 can be cooled by the cold of the cold water flowing through the water passage 65B. Moreover, the cooling passage 65A and the water passage 65B are disposed so as to obtain the counter flow of the milk and the water in the heat exchanger 65.

According to such a constitution, the milk pumped and collected by the milking machine is discharged from the milking machine to enter the cooling passage 65A of the heat exchanger. While flowing through the cooling passage 65A, the milk is cooled by the water flowing through the water passage 65B provided so as to perform the heat exchange between the passage and the cooling passage 65A, and then supplied to the milk tank 70. The milk in the milk tank 70 can be cooled by a refrigerator 75 disposed separately from the refrigerating apparatus 1 of the present invention.

That is, in the milk tank 70 of the embodiment, an evaporator 78 of a refrigerant circuit 76 of the refrigerator 75 is joined to the outside of an internal container for receiving the milk supplied from the milking machine so that the heat exchange can be performed, an outer sheath made of a stainless steel or the like is attached to the outside of the evaporator, and then a foam insulating material such as urethane is injected into a space between the interior and the outer shell. The evaporator 78 may be a tubular member (a heat conduction tube), a plate-like member (e.g., two plates are superimposed on each other, and the peripheries of both the plates are joined to each other by welding so that a gap between the plates is a passage (the evaporator) through which the refrigerant flows), or a member of another type. Moreover, in the refrigerant circuit 76 of the refrigerator 75, R22 (chlorodifluoromethane: $CHClF_2$) is sealed.

It is to be noted that the refrigerant of the refrigerator 75 is not limited to R22, and may be a refrigerant usually used as a refrigerant of a steam compression type refrigerating cycle. For example, R404A (a refrigerant made of R125 (pentafluoroethane: $CHF_2CF_3$), R143a (1,1,1-trifluoroethane: $CH_3CF_3$) and R134a (1,1,1,2-tetrafluoroethane-$CH_2FCF_3$)), carbon dioxide ($CO_2$) or the like may be used.

Then, the refrigerator 75 is operated to circulate the refrigerant through the refrigerant circuit 76 and to evaporate the refrigerant by the evaporator 78. In consequence, the milk stored in the milk tank 70 is cooled and kept.

The refrigerator 75 is operated and controlled so that the temperature of the milk in the milk tank 70 is kept at a predetermined low temperature (e.g., +4° C.) by control means of the refrigerator 75.

Furthermore, the inside of the milk tank 70 can be heated by the high temperature hot water in the hot water storage tank 20 of the hot water storage tank unit B. Specifically, one end of the hot water supply pipe 62 connected to the upper part of the hot water storage tank 20 is connected to the upper part of the milk tank 70. Moreover, the hot water supply valve 63 is opened to supply the high temperature hot water stored in the upper part of the hot water storage tank 20 to the upper part of the milk tank 70 through the hot water supply pipe 62. In consequence, the high temperature hot water can flow from the hot water storage tank 20 into the milk tank 70, whereby the inside of the milk tank 70 can be heated and sterilized by this high temperature hot water.

In addition, when the inside of the milk tank 70 is washed, the hot water supply valve 63 can be opened to open the hot water supply pipe 62, thereby supplying the high temperature hot water from the hot water storage tank 20 to the milk tank 70. According to such a constitution, the high temperature hot water of the hot water storage tank 20 can be used as washing water. In consequence, the milk tank 70 can be washed with the high temperature hot water having a high washing effect. It is to be noted that the pipe is not limited to the hot water supply pipe 62, and the hot water supply pipe 62 may be configured so that any pipe from the milking machine can be sterilized and washed.

Figure 3:
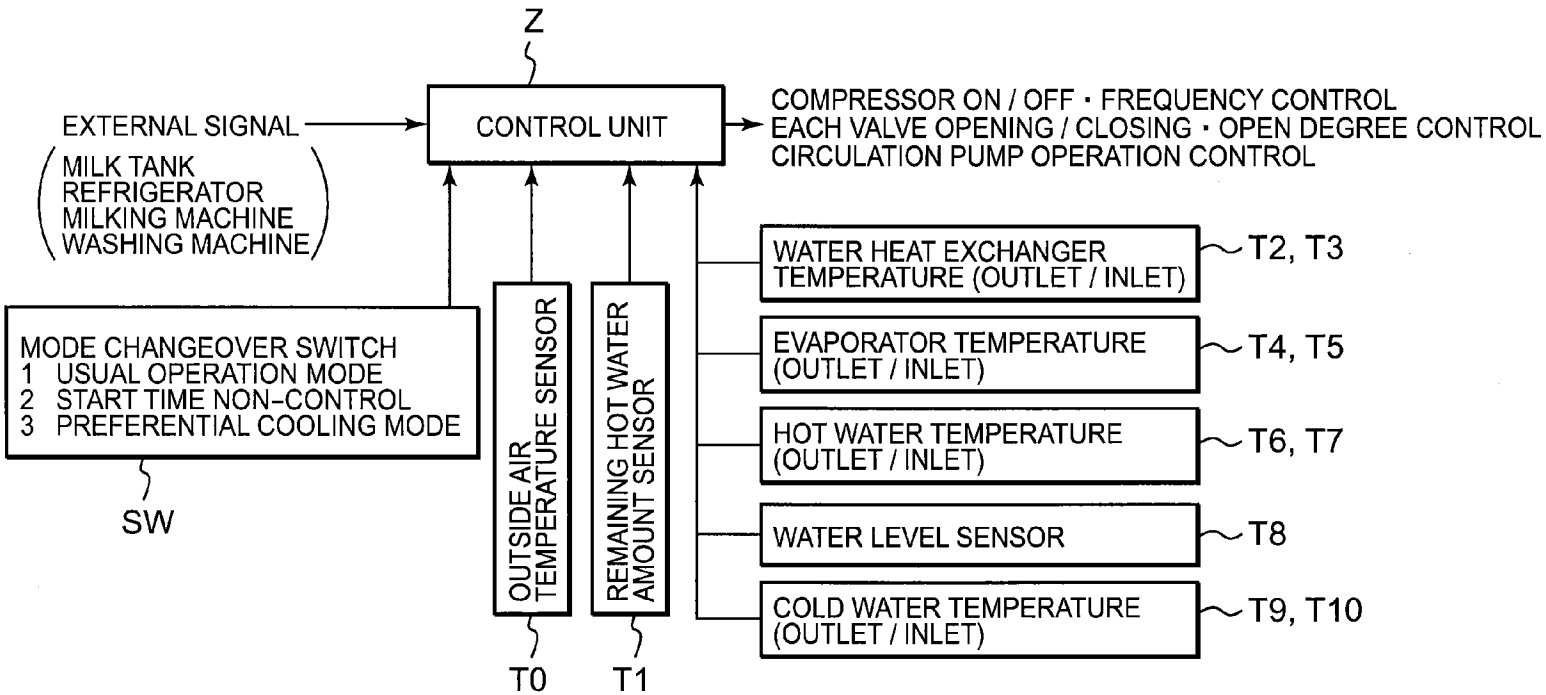
FIG. 3 is a control block diagram of a control unit of the refrigerating apparatus of FIG. 2.

Next, the control unit Z of the refrigerating apparatus 1 in the present embodiment will be described with reference to FIG. 3. The control unit Z is a general-purpose microcomputer. The input side of the control unit Z is connected to an outside air temperature sensor T0 which detects an outside air temperature; the hot water temperature detection sensors (the remaining cold water amount sensors) T1 provided in the hot water storage tank 20; the temperature sensor T2 provided at the inlet of the refrigerant passage 12A (the radiator) of the water heat exchanger 12; the temperature sensor T3 provided at the outlet of the refrigerant passage 12A (the radiator); the temperature sensor T4 provided at the inlet of the evaporator 14; the temperature sensor T5 provided at the outlet of the evaporator 14; the temperature sensor T6 at the inlet of the water passage 12B of the water heat exchanger 12; the temperature sensor T7 at the outlet of the water passage 12B; the water level sensor T8 provided in the ice cold storage tank 50; the temperature sensor T9 provided in the cold supply circuit 55 (the forwarding pipe 52) at the outlet of the ice cold storage tank 50; the temperature sensor T10 provided in the cold supply circuit 55 (the return pipe 54) at the inlet of the ice cold storage tank 50 and the like. Furthermore, the control unit Z can be configured to receive signals (external signals) from control means of the refrigerator 75 for cooling the milk tank 70 or the milking machine, and control means of a washing machine (not shown) for washing the inside of the milk tank 70.

Moreover, the output side of the control unit Z is connected to the refrigerant compressor 11 and the expansion valve 13 of the heat pump unit A; the water supply valve 22V, the discharge valves 28V, 29V and the pressure relief valve 69V of the hot water storage tank 20 of the hot water storage tank unit B; the circulation pump 31 of the water circuit 30; the water supply valve 58V and the discharge valve 59V of the ice cold storage unit C; the hot water supply valve 63 of the hot water supply circuit 60; the circulation pump 53 and the like. Moreover, the control unit Z controls the operation and frequency of the refrigerant compressor 11 connected to the output side thereof, the open degree of the expansion valve 13, the operation of the circulation pump 31, the operations of the valves 22V, 28V, 29V, 58V, 59V, 63, 69V and the like in accordance with input information (electric signals, temperature signals, etc.) from the sensors T0 to T10 connected to the input side thereof, the refrigerator 75, the milk tank 70, the milking machine and the washing machine.

In particular, on receiving the input information from the sensors connected to the input side or the predetermined signals from the control means, the control unit Z of the present invention starts the operation of the refrigerant compressor 11 to regulate the open degree of the expansion valve 13 so that the temperature of the refrigerant in the water heat exchanger 12 is +80° C. or more and so that the temperature (the evaporation temperature) of the refrigerant in the evaporator 14 is 0° C. or less. Specifically, the expansion valve 13 is controlled by the control unit Z so that the temperature of the refrigerant (hereinafter referred to as the refrigerant discharge temperature) discharged from the refrigerant compressor 11 to flow into the water heat exchanger 12 and detected by the temperature sensor T2 becomes a predetermined temperature (hereinafter referred to as the target discharge temperature). In this case, when the refrigerant discharge temperature detected by the temperature sensor T2 is lower than the target discharge temperature, the control unit Z decreases the open degree of the expansion valve 13. When the temperature is higher than the target discharge temperature, the control unit increases the open degree of the expansion valve 13.

The target discharge temperature is determined in accordance with demanded hot water supply load (corresponding to the hot water storage tank 20 in the present embodiment) and cooling load (corresponding to the water in the ice cold storage tank 50 of the ice cold storage unit C). Specifically, as described above, the target discharge temperature of the temperature sensor T2 is +80° C. or more, and the refrigerant temperature (the evaporation temperature) at the inlet of the evaporator 14 detected by the temperature sensor T4 is 0° C. or less. In this way, since the target discharge temperature is +80° C. or more, the hot water of +65° C. or more necessary for washing the milk tank 70 as described later is stored in the hot water storage tank 20, a sufficient refrigerating effect (a refrigerant ratio enthalpy difference between the outlet and the inlet of the evaporator 14) is acquired, and an efficient operation is performed.

If the temperature is lower than +80° C., it becomes difficult to supply the hot water having a temperature necessary for washing the milk tank 70, and a refrigerant heating/cooling ability remarkably lowers. Moreover, in consideration of the radiation, sterilizing effect or the like of the hot water, hot water having a temperature higher than +65° C. is preferably boiled, and in the present embodiment, hot water having a temperature of +85° C. is boiled. In this case, the target discharge temperature of the refrigerant discharge temperature detected by the temperature sensor T2 is +115° C. It is to be noted that the upper limit of the target discharge temperature is determined from the viewpoints of the deterioration of a lubricant, the burning or the like of a motor winding line, and the durability of the refrigerant compressor 11, and specifically, the temperature is +130° C. or less.

Here, a relation between the operation of the expansion valve 13 and the temperature (the evaporation temperature) of the refrigerant in the evaporator 14 will be described in detail. When the open degree of the expansion valve 13 is increased, the evaporation temperature of the refrigerant in the evaporator 14 rises. When the open degree of the expansion valve 13 is decreased, the evaporation temperature lowers. It is thus apparent that the evaporation temperature can be controlled by the open degree of the expansion valve 13. In the present embodiment, the open degree of the expansion valve 13 is controlled so that the temperature of the refrigerant discharged from the refrigerant compressor 11 is the target discharge temperature (+115° C.), and additionally, the expansion valve 13 is controlled by the control unit Z so that the evaporation temperature of the refrigerant in the evaporator 14 is 0° C. or less.

To realize such control, in the case of the operation at the target discharge temperature, the appropriate amount of the refrigerant is beforehand sealed so that the evaporation temperature is the predetermined temperature (0° C. or less), and the operation frequency (the revolution number) of the refrigerant compressor 11 needs to be set to an appropriate value. Such control can be performed to realize an efficient operation only by the control of the open degree of the expansion valve 13. It is to be noted that the evaporation temperature is set to 0° C. or less, whereby a storage capacity (a storage amount) is noticeably acquired for the volume of the ice cold storage tank 50 by effective use of latent heat during the phase change of the water. If the temperature is higher, the phase change from the water to the ices cannot be utilized.

It has been described above that the revolution number of the refrigerant compressor 11 is set to the predetermined value, but the revolution number may be controlled in accordance with the temperature of the cooling target (i.e., corresponding to the water in the ice cold storage tank 50 into which the evaporator 14 is immersed) or the evaporation temperature. For example, if the temperature of the cooling target (the water) is high, the revolution number of the refrigerant compressor 11 is increased. If the temperature of the cooling target (the water) is low, the revolution number of the refrigerant compressor 11 can be decreased.

When the revolution number of the refrigerant compressor 11 is increased, the heating/cooling ability increases, and the evaporation temperature lowers. On the other hand, when the revolution number of the refrigerant compressor 11 is decreased, the heating/cooling ability lowers, and the evaporation temperature rises. In this way, in addition to the control of the open degree of the expansion valve 13, the control of the revolution number of the refrigerant compressor 11 makes it possible to increase the cooling and heating abilities when the temperature of the cooling target (the water) is high, thereby rapidly cooling the cooling target (the water). Moreover, when the temperature of the cooling target (the water) lowers, the cooling ability can be suppressed to realize the efficient operation.

It is to be noted that it has been described above that the expansion valve 13 is controlled so as to set the temperature of the refrigerant discharged from the refrigerant compressor 11 to the target discharge temperature, but the present invention is not limited to this example, and the expansion valve 13 can be controlled so that the pressure of the refrigerant on the high pressure side of the refrigerant circuit 10, the superheat degree of the sucked refrigerant of the refrigerant compressor 11 or the like has a predetermined value.

Furthermore, the operation of the circulation pump 53 of the cold supply circuit 55 is controlled by the signal (the external signal) from the control means of the milking machine on the side of the milk tank 70. That is, on receiving the operation signal from the control means of the milking machine, the control unit Z starts the operation of the circulation pump 53, and controls the operation of the circulation pump 53 in accordance with the signal from the control means.

Moreover, the milk cooling system S of the present embodiment is provided with a mode changeover switch SW, and the mode changeover switch SW is also connected to the input side of the control unit Z. The mode changeover switch SW has the preferential cooling mode, a usual operation mode and a start time non-control mode, and any one of the modes can be selected by a user.

The usual operation mode and the start time non-control mode are operation modes to detect a state of a case where the cold storage amount in the ice cold storage tank 50 of the ice cold storage unit C reaches a predetermined amount or more (i.e., a case where the predetermined amount or more of the ices are produced in the ice cold storage tank 50, and this state will hereinafter be referred to as the state of being full of the ices) or a state of a case where it is judged that the hot water storage tank 20 is full of the hot water, after the elapse of a predetermined time from the start of the operation of the refrigerant compressor 11, and to stop the operation of the refrigerant compressor 11 when either state is satisfied. Moreover, in these operation modes, the operation of the refrigerant compressor 11 is not started in a case where it is judged that the ice cold storage tank 50 is full of the ices or that the hot water storage tank 20 is full of the hot water, and the operation of the refrigerant compressor 11 is started only when the ice cold storage tank 50 is not full of the ices and the hot water storage tank 20 is not full of the hot water.

On the other hand, the preferential cooling mode is an operation mode to execute the ice cold storage in the ice cold storage tank 50 of the ice cold storage unit C by operating the refrigerant compressor 11 until the ice cold storage tank 50 is full of the ices in a case where it is judged that the hot water storage tank 20 is full of the hot water but that the ice cold storage tank 50 of the ice cold storage unit C is not full of the ices. Moreover, in the preferential cooling mode, when the hot water storage tank 20 is full of the hot water but the ice cold storage tank 50 is not full of the ices, the operation of the refrigerant compressor 11 is started.

Moreover, the control unit Z controls the operation in the operation mode selected by the mode changeover switch SW. Furthermore, in the usual operation mode, at a predetermined time in late night hours, a boiling amount is calculated from the amount of the stored hot water, and a time necessary for the whole boiling amount is calculated, and the start time of the operation is controlled by the control unit Z so as to start the operation at a time T counted backward from a boiling completion time in consideration of the above necessary time. However, in the start time non-control mode, the operation is immediately started regardless of the start time T. A specific control operation will be described later. It is to be noted that in the present embodiment, each mode is selected by the mode changeover switch SW, but the present invention is not limited to this embodiment, and the mode may be switched by the control means of the refrigerator 75 or another external signal.

Figure 4:
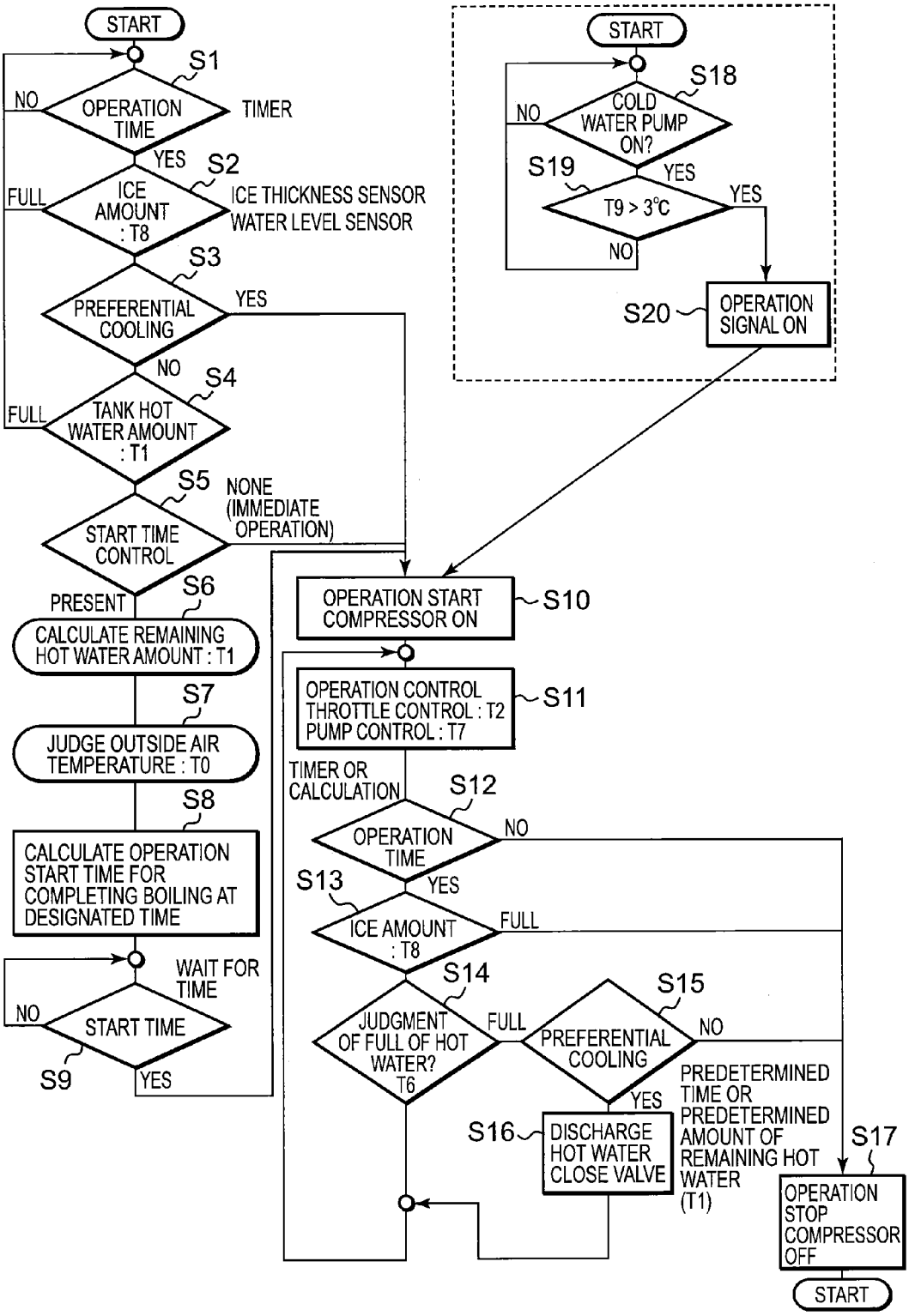
FIG. 4 is a flow chart showing the control operation of the control unit of the refrigerating apparatus of FIG. 2.

Next, the control operation of the control unit Z having the above constitution in the present embodiment will be described with reference to FIG. 4. FIG. 4 is a flow chart showing the control of the control unit Z. First, the control unit Z judges an operation time by a timer owned as its own function in step S1. That is, the control unit Z judges the operation time in late night power hours in the step S1 (YES), and advances to the next step S2. Moreover, in another case (NO), the step S1 is repeated till the operation time.

Next, in the step S2, the control unit Z judges the amount of the ices (the cold storage amount) in the ice cold storage tank 50 of the ice cold storage unit C based on the output of the sensor T8. In this case, when the amount of the ices in the ice cold storage tank 50 detected by the sensor T8 is a predetermined amount or more (the cold storage amount in the ice cold storage tank 50 is a predetermined amount or more), the control unit judges that the tank is full of the ices, and returns to the step S1. On the other hand, in a case where the control unit Z judges that tank is not full of the ices, the unit advances to step S3 to judge the operation mode.

That is, in the step S3, the control unit Z judges whether or not the preferential cooling mode is selected by the mode changeover switch SW. Then, in the case of the usual operation mode or the start time non-control mode, that is, when the operation mode is not the preferential cooling mode (NO), the control unit Z advances to step S4. On the other hand, in a case where in the step S3, the control unit Z judges that the preferential cooling mode is selected by the switch (YES), the control unit prepares an operation signal by itself to advance to step S10 described later. It is to be noted that the control unit may calculate a necessary operation time based on the amount of the ices in the ice cold storage tank 50 to control the operation start time.

In the step S4, the control unit Z judges based on the output of the sensors T1 whether or not the hot water storage tank 20 is full of the hot water. That is, the judgment (corresponding to the step S4) of whether or not the hot water storage tank 20 is full of the hot water before the operation start (a state in which the refrigerant compressor 11 does not operate) is performed based on the water temperature (the hot water temperature) in the hot water storage tank 20 detected by the temperature sensors T1 provided in the hot water storage tank 20. That is, the control unit Z judges that the tank is full of the hot water in a case where the temperature detected by the temperature sensor disposed at the lowermost position among the plurality of temperature sensors T1 disposed at the varying heights is higher than the predetermined temperature (e.g., +50° C.).

When the hot water storage tank 20 is full of the hot water in the step S4, the control unit Z returns to the step S1. Therefore, in a case where the control unit Z judges that the tank is full of the ices in the step S2, or in a case where the control unit does not judge that the tank is full of the ices in the step S2 but judges that the tank is full of the hot water in the step S4, the control unit returns to the step S1, whereby in either case, the refrigerant compressor 11 is not operated.

On the other hand, when the hot water storage tank 20 is not full of the hot water in the step S4, the control unit Z advances to step S5. In the step S5, the control unit Z judges whether or not the start time is controlled by the mode changeover switch SW. Moreover, in the case of the usual operation mode, the control unit Z judges that the start time control is not performed, and advances to the next step S6.

It is to be noted that when in the step S5, the start time non-control mode is selected by the mode changeover switch SW, the control unit Z judges that the start time is not controlled (the operation is immediately performed), and shifts to the step S10 described later.

On the other hand, the control unit Z judges (calculates) the amount of the remaining hot water in the hot water storage tank 20 based on the output from the sensors T1 in the step S6, judges the outside air temperature by the outside air temperature sensor T0 in the next step S7, and then calculates, from the amount of the remaining hot water and the outside air temperature, a time when the refrigerant compressor 11 is to be operated to complete the boiling (the whole boiling amount) of the hot water storage tank 20 at a designated time (the time of the end of the late night power hours, e.g., seven o' clock in the morning), that is, the operation start time T.

After calculating the operation start time T in step S8, the control unit Z next advances to step S9, and is on standby till the operation start time T (waits for the start time T). Then, at the operation start time T, the control unit Z prepares the operation signal by itself to advance to the step S10.

Then, the control unit Z starts the operation of the refrigerant compressor 11 in the step S10 (compressor ON). In consequence, a low-temperature low-pressure refrigerant gas sucked into the refrigerant compressor 11 is compressed by the low stage side compression element of a first stage, obtains an intermediate pressure, and is discharged into the sealed container. The refrigerant discharged into the sealed container is compressed by the high stage side compression element of a second stage, and is discharged as a high-temperature high-pressure refrigerant gas from the refrigerant compressor 11.

The high-temperature high-pressure refrigerant gas discharged from the refrigerant compressor 11 flows into the refrigerant passage (the radiator) 12A of the water heat exchanger 12 through the refrigerant discharge pipe 41. While the gas flows through the refrigerant passage 12A, the heat exchange is performed between the gas and the water flowing through the water passage 12B, thereby radiating heat. Then, the refrigerant which has radiated the heat is discharged from the water heat exchanger 12, and flows through the refrigerant pipe 42 and the high pressure side pipe 15A of the internal heat exchanger 15. At this time, in the internal heat exchanger 15, the heat exchange is performed between the refrigerant flowing through the refrigerant passage 12A and the high pressure side pipe 15A and the refrigerant discharged from the evaporator 14 and flowing through the low pressure side pipe 15B, thereby further radiating the heat. The internal heat exchanger 15 is provided in this manner, whereby the refrigerant discharged from the water heat exchanger 12 and flowing through the high pressure side pipe 15A is cooled by the low pressure side refrigerant discharged from the evaporator 14 and flowing through the low pressure side pipe 15B, and hence the cooling ability can be improved.

Afterward, the refrigerant is discharged from the internal heat exchanger 15, and enters the expansion valve 13 through the refrigerant pipe 43, whereby the pressure of the refrigerant is decreased by the expansion valve 13. The refrigerant whose pressure has been decreased by the expansion valve 13 enters the evaporator 14 through the refrigerant pipe 44, absorbs the heat from ambient water in the evaporator 14 (i.e., the water in the ice cold storage tank 50), evaporates, is discharged from the evaporator 14, passes through the refrigerant pipe 45, and flows through the low pressure side pipe 15B of the internal heat exchanger 15. In the internal heat exchanger 15, the refrigerant discharged from the evaporator 14 and flowing through the low pressure side pipe 15B is heated by the heat exchange between the refrigerant and the refrigerant flowing through the refrigerant passage 12A and the high pressure side pipe 15A. The internal heat exchanger 15 is provided in this manner, whereby even when the refrigerant is not completely gasified in the evaporator 14, the refrigerant is heated by the heat exchange between the refrigerant and the refrigerant flowing through the high pressure side pipe 15A in the internal heat exchanger 15, and the refrigerant can be gasified.

Then, the refrigerant discharged from the internal heat exchanger 15 repeats such a cycle that the refrigerant flows through the refrigerant pipe 46 and the accumulator 16 and is again sucked into the refrigerant compressor 11 through the refrigerant introduction pipe 40. Such an operation is performed to cool the water in the ice cold storage tank 50 around the evaporator 14 by the heat absorbing function of the refrigerant in the evaporator 14, whereby the temperature gradually lowers to produce the ices.

Moreover, the control unit Z starts the operation of the circulation pump 31 of the water circuit 30 simultaneously with the start of the refrigerant compressor 11, and controls the three-way valve 32 so as to connect the bypass pipe 37 to the water pipe 34. In consequence, the water in the water circuit 30 repeats circulation through the water pipe 34, the water passage 12B of the water heat exchanger 12, the water pipe 35, the bypass pipe 37 and the three-way valve 32 to return to the water pipe 34 again. In a situation in which the refrigerant flowing through the refrigerant passage 12A of the water heat exchanger 12 immediately after the startup does not sufficiently reach the high temperature in this manner, the three-way valve 32 is controlled so that the water in the water circuit 30 flows through the closed circuit to return to the water passage 12B of the water heat exchanger 12 through the water pipe 35, the bypass pipe 37, the three-way valve 32 and the water pipe 34, which can avoid disadvantage that the water having a low temperature flows into the upper part of the hot water storage tank 20 to disturb the temperature stratification in the hot water storage tank 20.

Then, the control unit Z controls the three-way valve 32 so as to connect the water takeout pipe 27 to the water pipe 34 after the elapse of a predetermined short time from the start of the operation of the refrigerant compressor 11, or when the refrigerant discharge temperature detected by the temperature sensor T2 reaches the predetermined high temperature (e.g., +115° C.) or the hot water outflow temperature detected by the temperature sensor T7 reaches the predetermined high temperature (e.g., +80° C.). In consequence, the low temperature water (mainly the tap water supplied to the lower part of the hot water storage tank 20 through the water supply pipe 22) in the lower part of the hot water storage tank 20 is discharged to the water takeout pipe 27 of the water circuit 30 connected to the lower part of the hot water storage tank 20.

The low temperature water (the tap water) discharged from the hot water storage tank 20 to the water circuit 30 flows into the water passage 12B of the water heat exchanger 12 through the three-way valve 32 and the water pipe 34. While the water flowing into the water heat exchanger 12 flows through the water passage 12B of the water heat exchanger 12, the water is heated by the heat exchange between the water and the high temperature refrigerant flowing through the refrigerant passage 12A provided so as to perform the heat exchange between the passage and the water passage 12B, thereby producing the high temperature hot water. The high temperature water (the hot water) heated in the water heat exchanger 12 repeats such a cycle as to return to the hot water storage tank 20 through the water pipe 35 and the upper part of the tank. Such a cycle is repeated to gradually store the high temperature hot water in the hot water storage tank 20.

On the other hand, as described above in step S11, the control unit Z regulates the valve open degree of the expansion valve 13 (throttle control) so that the refrigerant discharge temperature detected by the temperature sensor T2 is +80° C. or more (115° C. in the present embodiment) and so that the refrigerant evaporation temperature in the evaporator 14 is 0° C. or less, and the control unit controls the operation of the circulation pump 31 detected by the detection of the temperature sensor T7 provided on the outlet side of the water heat exchanger 12 of the water circuit 30.

Specifically, the control unit Z controls the operation of the circulation pump 31 so that the hot water outflow temperature detected by the temperature sensor T7 is the predetermined temperature (the target hot water outflow temperature). That is, when the hot water outflow temperature detected by the temperature sensor T7 is lower than the predetermined target temperature, the revolution number of the circulation pump 31 is lowered to decrease the circulation amount. On the other hand, when the hot water outflow temperature is higher than the target hot water outflow temperature, the revolution number of the circulation pump 31 is raised to increase the circulation amount.

Next, the control unit Z advances to step S12, and judges a time (the operation time) elapsed after starting the operation in the step S10 by its timer or calculation. That is, in the step S12, the control unit Z judges again whether or not the operation time is in the late night power hours, and advances to step S13 in the case of the late night hours (YES). It is to be noted that when the operation time is not in the late night hours (NO), the control unit shifts to step S17 to immediately stop the operation of the refrigerant compressor 11 (compressor OFF).

In the step S13, the control unit Z judges the amount of the ices (the cold storage amount) in the ice cold storage tank 50 of the ice cold storage unit C by the water level sensor T8. At this time, in a case where the amount of the ices in the ice cold storage tank 50 is the predetermined amount or more (the cold storage amount in the ice cold storage tank 50 is the predetermined amount or more), the control unit Z judges that the tank is full of the ices, and advances to the step S17 to stop the refrigerant compressor 11 (compressor OFF). On the other hand, in a case where in the step S13, the amount of the ices in the ice cold storage tank 50 detected by the water level sensor T8 is less than the predetermined amount (the cold storage amount in the ice cold storage tank 50 is less than the predetermined amount), the control unit Z judges that the tank is not full of the ices, and then advances to step S14 to judge the amount of the hot water in the hot water storage tank 20 by the sensor T6.

In the step S14, the control unit Z judges based on the sensor T6 whether or not the hot water storage tank 20 is full of the hot water. In the step S14, it is judged whether or not the tank is full of the hot water, that is, whether or not the hot water storage tank 20 is full of the hot water during the operation (in a state in which the refrigerant compressor 11 operates) based on the temperature of the water flowing into the water passage 12B of the water heat exchanger 12 and detected by the temperature sensor T6. Specifically, when the temperature of the water flowing into the water passage 12B of the water heat exchanger 12 and detected by the temperature sensor T6 is higher than a predetermined value, the control unit Z judges that the hot water storage tank 20 is filled with the hot water (full of the hot water). When the temperature is the predetermined value or less, the control unit judges that the hot water storage tank 20 is not filled with the hot water (is not full of the hot water). In this way, it is judged whether or not the hot water storage tank 20 is full of the hot water by the temperature detected by the temperature sensor T6 provided in the water pipe 34, whereby the volume of even the lower part of the hot water storage tank 20 can effectively be utilized to store the hot water.

When the tank is not full of the hot water in the step S14, the control unit Z returns to the step S11. On the other hand, when the tank is full of the hot water in the step S14, the control unit Z advances to step S15 to judge the operation mode selected by the mode changeover switch SW in the same manner as described above. Here, in the case of the preferential cooling mode, the control unit Z advances to step S16, and opens the discharge valve 29V (corresponding to the hot water discharge valve shown in FIG. 4), thereby opening the discharge pipe 29. At this time, the discharge valve 28V of the discharge pipe 28 is closed as it is.

In consequence, the hot water in the lower part of the hot water storage tank 20 is discharged to the outside thereof through the discharge pipe 29. At this time, the hot water discharged through the discharge pipe 29 is the hot water having a temperature lower than the high temperature hot water stored in the upper part of the hot water storage tank 20, that is, a comparatively low temperature. Accordingly, the tap water is supplied into the hot water storage tank 20 through the water supply pipe 22 connected to the lower part of the hot water storage tank 20, whereby the water in the lower part of the hot water storage tank 20 has a low temperature. In consequence, the heat radiation amount for producing the ices can be acquired in the ice cold storage tank 50 of the ice cold storage unit C.

That is, when the hot water storage tank 20 is full of the hot water in the preferential cooling mode, the high temperature hot water is discharged from the lower part of the hot water storage tank 20 and the low temperature water is supplied thereinto, whereby the low temperature water can flow through the water passage 12B of the water heat exchanger 12. In consequence, the heat exchange is performed between the refrigerant and the water in the water heat exchanger 12, and the refrigerant can radiate the heat. Therefore, while eliminating disadvantages that the heat radiation amount of the refrigerant in the water heat exchanger 12 runs short and that the refrigerant circuit is overloaded, the ices of the ice cold storage tank 50 can safely and securely be produced.

Then, in the step S16, the control unit Z closes the discharge valve 29V after the elapse of a predetermined time from the opening of the discharge valve 29V, or when the amount of the remaining hot water in the hot water storage tank 20 detected by the sensors T1 becomes the predetermined amount of the remaining hot water. This stops the discharge of the high temperature hot water from the lower part of the hot water storage tank 20 and the inflow of the tap water from the lower part of the hot water storage tank 20. Afterward, the control unit Z returns to the step S11 to continue the operation of the refrigerant compressor 11 until the tank is full of the ices in the step S13, and advances to the step S17 to stop the operation of the refrigerant compressor 11 when the tank is full of the ices in the step S13 (compressor OFF). Moreover, in the step S17, the control unit Z also stops the operation of the circulation pump 31 simultaneously with the stop of the refrigerant compressor 11.

It is to be noted that when the control unit Z stops the operations of the refrigerant compressor 11 and the circulation pump 31 in the step S17, the control unit returns to the step S1, thereby repeating the above operation. In this case, in the step S4, it is judged whether or not the hot water storage tank 20 is full of the hot water based on detection of the sensors T1 as described above. In this way, it is judged whether or not the hot water storage tank 20 is full of the hot water based on the temperature detected by the temperature sensors T1, whereby the water temperature of the water pipe 34 lowers by the heat radiation to eliminate the influence of the lowering of the detected temperature, which makes it possible to securely judge the amount of the remaining hot water. In this state, within the operation time (i.e., in the late night power hours) (YES in the step S1) and when the operation mode selected by the mode changeover switch is other than the preferential cooling mode (NO in the step S4) and the hot water of the hot water storage tank 20 is consumed, it is judged in the step S4 that the hot water storage tank 20 is not full of the hot water, whereby the operation is started again.

The cold (the ices) stored in the ice cold storage tank 50 of the ice cold storage unit C by the above operation is discharged from the ice cold storage tank 50 by the operation of the circulation pump 53, and flows through the heat exchanger 65. Specifically, when the milking starts, a signal is transmitted from the control means of the milking machine to the control unit Z. On receiving this signal (the external signal), the control unit Z starts the operation of the circulation pump 53. At this time, the control unit Z may control the flow rate of the cold water flowing through the water passage 65B of the heat exchanger 65 by the circulation pump 53 so that the temperature of the milk or the temperature of the water subjected to the heat exchange between the water and the milk in the water passage 65B of the heat exchanger 65, returning to the ice cold storage tank 50 and detected by the temperature sensor T10 becomes a predetermined value (e.g., the temperature of the water detected by the temperature sensor T10 becomes +4° C.).

When the circulation pump 53 starts, the cold (the ices) stored in the ice cold storage tank 50 of the ice cold storage unit C is discharged from the lower part of the ice cold storage tank 50 to the forwarding pipe 52 of the cold supply circuit 55, and flows into the water passage 65B of the heat exchanger 65. In the heat exchanger 65, the cold water from the ice cold storage tank 50 performs the heat exchange between the cold water and the milk flowing through the cooling passage 65A provided so as to perform the heat exchange between the passage and the water passage 65B, while passing through the water passage 65B, whereby the cold is released to the milk. In consequence, the milk flowing through the refrigerant passage 65A is cooled. In the heat exchanger 65, the warmed water which has received the heat of the milk repeats such a cycle that the water is discharged through the water passage 65B, passes through the return pipe 54 and returns to the ice cold storage tank 50 through the upper part thereof.

On the other hand, the high temperature hot water stored in the hot water storage tank 20 of the hot water storage tank unit B by the above operation is supplied into the milk tank 70 by the operation of the hot water supply valve 63. Specifically, on receiving the signal (the external signal) from the control means on a milk tank 70 side, the control unit Z opens the hot water supply valve 63 to open the hot water supply pipe 62. In consequence, the high temperature hot water stored in the upper part of the hot water storage tank 20 is supplied to the upper part of the milk tank 70 through the hot water supply pipe 62.

In consequence, by the signal from the milk tank 70 side, the high temperature hot water of the hot water storage tank 20 can be supplied into the milk tank 70, and hence the milk tank 70 can be heated and sterilized by the high temperature hot water. Furthermore, when the inside of the milk tank 70 is washed, the hot water supply valve 63 is controlled to open, whereby the high temperature hot water of the hot water storage tank 20 can be used as the washing water. In consequence, the inside of the milk tank 70 can effectively be washed.

As described above in detail, according to the present invention, the milk supplied to the milk tank 70 can be cooled by utilizing the cold storage in the ice cold storage tank 50 of the ice cold storage unit C by the late night power, which can decrease power consumption. Moreover, the high temperature hot water of the hot water storage tank 20 produced by the late night power is similarly utilized for heating or washing the milk tank 70, which can suppress the power consumption to realize the heating sterilization and effective washing of the inside of the milk tank 70.

(Embodiment 2)

It is to be noted that it has been described in the above embodiment that the control unit Z performs the operation start judgment control to judge the operation time by the timer as its function and to start the operation in the step S1 (FIG. 4) as described above, but the present invention is not limited to this embodiment, and the control unit may start the operation by the lowering of the cooling ability of the ice cold storage unit C. Specifically, in step S18 shown in FIG. 4, the control unit Z judges whether or not a circulation pump 53 (corresponding to a cold water pump of the step S18 of FIG. 4) is operated, and advances to step S19 when the pump is operated (YES), but returns to the step S18 when the pump is not operated (NO), and repeats the step S18 until the circulation pump 53 is operated.

Next, in the step S19, the control unit Z detects, by a temperature sensor T9, the temperature of cold water discharged from an ice cold storage tank 50 to a forwarding pipe 52 of a cold supply circuit 55 (i.e., corresponding to the temperature of the cold water in the ice cold storage tank 50, and judges whether or not the temperature of the cold water is higher than a predetermined upper limit temperature (e.g., +3° C.). In the step S19, when the temperature of the cold water is +3° C. or less (NO), the control unit returns to the step S18. Moreover, in the step S19, when the temperature of the cold water is higher than +3° C. (YES), the control unit Z advances to step S20 to generate an operation signal. Afterward, the control unit Z advances to step S10 of FIG. 4, and the subsequent operation is similar to that described above in Embodiment 1.

Moreover, the present invention is not limited to the above embodiments, and the present invention is effective also when the operation start is controlled by the external signal of, for example, the control means of the refrigerator 75 on the milk tank 70 side.

Furthermore, in the above embodiments, the constitution of the refrigerating apparatus 1 divided into the heat pump unit A, the hot water storage tank unit B and the ice cold storage unit C has been described, but the arrangement of the constituent elements is not limited to the embodiments. For example, in the embodiments, the hot water supply valve 63 is provided in the hot water storage tank unit B, but may be provided in the milk tank 70, the milking machine or the washing machine. In this case, the operation of the hot water supply valve 63 is not performed by communication with the control unit Z, but the valve can directly be opened or closed by the signal from the milk tank 70, the milking machine or the washing machine.

What is claimed is:

1. A refrigerating apparatus comprising:

a refrigerant circuit in which a refrigerant compressor, a water heat exchanger, a pressure reducing device and an evaporator are annularly connected by refrigerant pipes;

a first bypass pipe, which connects the compressor to a refrigerant pipe connected to an outlet of a refrigerant passage of the water heat exchanger, is provided in the refrigerant circuit;

a hot water storage tank having a lower part through which tap water is supplied and an upper part through which hot water stored therein is discharged;

a water circuit in which the tap water in the lower part of the hot water storage tank is heated by the water heat exchanger and then returned to the upper part of the hot water storage tank;

a three-way valve provided in the water circuit;

a cold storage unit into which the evaporator is immersed; and a control unit configured to start an operation of the refrigerant compressor in response to an operation signal and configured to regulate the pressure reducing device so that the temperature of a refrigerant in the water heat exchanger becomes +80 ° C. or more and so that the temperature of the refrigerant in the evaporator becomes 0 ° C. or less, wherein the control unit is configured to detect a state where an amount of ice in the cold storage unit reaches a predetermined amount or more and another state where the control unit is configured to judge whether the hot water storage tank is full of the hot water, after the elapse of a predetermined time from the start of the operation of the refrigerant compressor, and stops the operation of the refrigerant compressor when one of the states is satisfied, and wherein the control unit configured to control the three-way valve so as to prevent the water in the water circuit that has a temperature lower than a predetermined high temperature to flow into the upper part of the hot water storage tank, and wherein the refrigerant circuit comprises an internal heat exchanger and a second bypass pipe, which connects the first bypass pipe to a refrigerant pipe connected to an outlet of a low pressure side pipe of the internal heat exchanger, is provided in the refrigerant circuit.

2. The refrigerating apparatus according to claim 1, wherein milk to be supplied to a milk tank is cooled by cold water supplied from the cold storage unit, and the inside of the milk tank is heated or washed by using the hot water in the hot water storage tank.

3. The refrigerating apparatus according to claim 1, wherein the cold storage unit is configured to produce ice therein.

4. The refrigerating apparatus according to claim 1, wherein the control unit having a preferential cooling mode, in which the control unit, after having judged that the hot water storage tank is full of the hot water, is configured to discharge the hot water from the hot water storage tank to continue the operation of the refrigerant compressor.

5. The refrigerating apparatus according to claim 1, wherein:

the first and second bypass pipes each provided with an evacuating bypass valve that are opened during refrigerant charging, and a charge valve provided in the second bypass pipe for charging the refrigerant.

* * * * *